US007753087B2

(12) United States Patent
Rhodenbaugh et al.

(10) Patent No.: US 7,753,087 B2
(45) Date of Patent: Jul. 13, 2010

(54) PRODUCT DISPENSING SYSTEM

(75) Inventors: Joseph W. Rhodenbaugh, Indian Hill, OH (US); Terry M. Birchler, New Albany, OH (US); Mark C. Eyman, Columbus, OH (US); Kristen K. Hedstrom, Orlando, FL (US)

(73) Assignee: Kutol Products Company, Inc., Cincinnati, OH (US)

( * ) Notice: Subject to any disclaimer, the term of this patent is extended or adjusted under 35 U.S.C. 154(b) by 1302 days.

(21) Appl. No.: 11/253,372

(22) Filed: Oct. 19, 2005

(65) Prior Publication Data

US 2007/0084521 A1 Apr. 19, 2007

(51) Int. Cl.
*B67C 3/00* (2006.01)

(52) U.S. Cl. ..... 141/18; 141/366; 222/521

(58) Field of Classification Search ..... 141/2, 141/18, 21, 22, 346, 351–355, 363–366, 141/114; 222/519–521
See application file for complete search history.

(56) References Cited

U.S. PATENT DOCUMENTS

| | | | | |
|---|---|---|---|---|
| 2,772,116 | A | 11/1956 | Dobkin | |
| 4,149,573 | A | 4/1979 | Cassia | |
| 4,173,858 | A | 11/1979 | Cassia | |
| 4,280,638 | A | 7/1981 | Keihm | |
| 4,322,019 | A | 3/1982 | Smith | |
| 4,664,292 | A * | 5/1987 | Jeans | 222/1 |
| 4,927,065 | A | 5/1990 | Beck | |
| 4,967,941 | A | 11/1990 | Beck | |
| 5,029,624 | A * | 7/1991 | McCunn et al. | 141/346 |
| 5,226,566 | A | 7/1993 | Brandenburg | |
| 5,425,404 | A * | 6/1995 | Dyer | 141/351 |
| 5,632,414 | A | 5/1997 | Merriweather, Jr. | |
| 5,947,171 | A * | 9/1999 | Woodruff | 141/346 |
| 5,967,197 | A | 10/1999 | Shown | |
| 6,050,309 | A | 4/2000 | Woodruff | |
| 6,085,809 | A | 7/2000 | Woodruff | |
| 6,142,342 | A | 11/2000 | Lewis | |
| 6,223,791 | B1 * | 5/2001 | Arsenault et al. | 141/291 |
| 6,263,928 | B1 | 7/2001 | Woodruff | |
| 6,305,444 | B1 | 10/2001 | Woodruff | |
| 6,325,115 | B1 * | 12/2001 | Cowland et al. | 141/346 |
| 6,354,346 | B2 * | 3/2002 | Arsenault et al. | 141/291 |
| 6,450,214 | B1 * | 9/2002 | Dyer et al. | 141/9 |
| 6,467,651 | B1 | 10/2002 | Muderlak et al. | |
| 6,543,496 | B2 | 4/2003 | Woodruff | |
| 6,651,851 | B2 | 11/2003 | Muderlak et al. | |
| 6,732,772 | B2 | 5/2004 | Woodruff | |
| 6,748,966 | B1 | 6/2004 | Dvorak | |
| 2003/0106612 | A1 | 6/2003 | Vincent, III et al. | |

* cited by examiner

*Primary Examiner*—Gregory L. Huson
*Assistant Examiner*—Jason K Niesz
(74) *Attorney, Agent, or Firm*—Dinsmore & Shohl LLP

(57) ABSTRACT

A product dispensing system includes a receptacle for storing a product, a fill column, and a refill dispenser. The fill column is in fluid communication with the receptacle and is configured for selective and alternative securement to a housing and the refill dispenser. The refill dispenser includes a container configured to transfer a product and a cap assembly extending adjacent to the container. The cap assembly has a fill position. Upon rotation of the cap assembly about the fill column, the cap assembly is moved into the fill position so that the product from the container can be transferred to the receptacle.

17 Claims, 17 Drawing Sheets

PRODUCT DISPENSING SYSTEM

TECHNICAL FIELD

The present invention relates to a product dispensing system such as might be used to dispense hand soap.

BACKGROUND OF THE INVENTION

It is common for a commercial establishment to have a public restroom which includes a hand soap dispenser which is mounted through a hole in a sink or countertop. As such a dispenser is fixedly mounted to the sink or countertop, it is unlikely that it will be removed or damaged by a customer. Furthermore, such a mounting configuration helps to ensure that any inadvertent soap drippage is likely to fall within (or at least near) a washbasin, thereby facilitating more efficient cleaning of the restroom. Additionally, by placing soap near the washbasin in this manner, persons may easily and conveniently access the soap when washing their hands.

However, such conventional soap dispensers are not without disadvantage. In particular, once the soap content of such a dispenser is depleted, the refilling process can be difficult and/or messy. For example, in one conventional configuration, a custodian must reach beneath the sink and unscrew a storage reservoir, fill it, and then again reach under the sink to reattach the reservoir. This process is inconvenient and time consuming. In another conventional configuration, the head of a soap dispenser can simply be pulled or otherwise extracted so that an operator can pour soap in to the soap dispenser. However, such pouring often results in overfilling and/or significant quantities of spilled soap.

SUMMARY OF THE INVENTION

In accordance with one embodiment of the present invention, a refill dispenser is provided which comprises a container, a cap assembly, and a guide element. The container is configured to hold a product. The cap assembly extends adjacent to the container and has a fill position. The guide element is provided upon the cap assembly and is removably received in a groove of a fill column so that the cap assembly may be moveably secured within the fill column. Upon rotation of the cap assembly about the fill column, at least a portion of the cap assembly is configured to be axially displaced within the fill column and into the fill position.

In accordance with another embodiment of the present invention, a refill dispenser is provided which has a cap assembly. The cap assembly comprises a cap body, a cap head, a guide element, and a flange element. The cap body has a metering portion. The cap head is mounted to the metering portion and is rotatable about the metering portion of the cap body for selectively moving the cap assembly between an opened position and a closed position. The guide element is provided upon the cap body and is configured to removably secure the cap body to a fill column. The flange element extends is provided upon the cap head and is configured to be moveably secured within a channel of the fill column. Upon rotation of the cap body about the fill column, the cap assembly moves between the opened position and the closed position.

In accordance with yet another embodiment of the present invention, a refill dispenser is provided in combination with a fill column. The combination comprises a container, a cap assembly, and a fill column. The container is configured to hold a product. The cap assembly extends adjacent to the container and comprises a cap body, a cap head, and a guide element. The cap head is mounted to the cap body and is rotatable with respect to the cap body for selectively moving the cap assembly between an opened position and a closed position. The guide element is provided upon the cap assembly. The fill column comprises inner and outer peripheries. The outer periphery comprises a housing mount for securing a housing to the outer periphery of the fill column. The inner periphery comprises a groove for removably receiving the guide element so that the cap assembly is moved between the opened position and the closed position upon rotation of the cap body about the fill column.

In accordance with still another embodiment of the present invention, a product dispenser is provided which comprises a receptacle for storing product and a fill column in fluid communication with the receptacle. The fill column comprises a housing mount for removably securing a housing to the fill column. The fill column further comprises a groove for removably receiving a guide element of a cap assembly of a refill dispenser.

In accordance with yet another embodiment of the present invention, a product dispensing system is provided which comprises a receptacle for storing a product, a fill column, and a refill dispenser. The fill column is in fluid communication with the receptacle and comprises an outer periphery configured for selective securement to a housing. The refill dispenser comprises a container configured to transfer a product and a cap assembly extending adjacent to the container. The cap assembly has a fill position. Upon rotation of the cap assembly about the fill column, the cap assembly is moved into the fill position so that the product from the container can be transferred to the receptacle.

BRIEF DESCRIPTION OF THE DRAWINGS

While the specification concludes with claims particularly pointing out and distinctly claiming the present invention, it is believed that the same will be better understood from the following description taken in conjunction with the accompanying drawings in which:

DETAILED DESCRIPTION

The present invention and its operation are hereinafter described in detail in connection with the views and examples of FIGS. 1-18, wherein like numbers indicate the same or corresponding elements throughout the views. These embodiments are shown and described only for purposes of illustrating examples of the elements of the invention, and should not be considered as limiting on alternative structures or assemblies that will be apparent to those of ordinary skill in the art.

A product dispensing system in accordance with the teachings of the present invention can be provided upon a sink or countertop in a residential, industrial, or commercial environment and can be configured to dispense a product. In one embodiment, a product dispensing system might be configured to dispense liquid or foamed soap. However, any of a variety of other products might alternatively be dispensed by a product dispensing system in accordance with the present invention. Such alternative products might include food condiments (e.g., ketchup), industrial chemicals (e.g., motor oil), and/or any of a variety of other products for any of a variety of other uses or applications.

Figure 1:
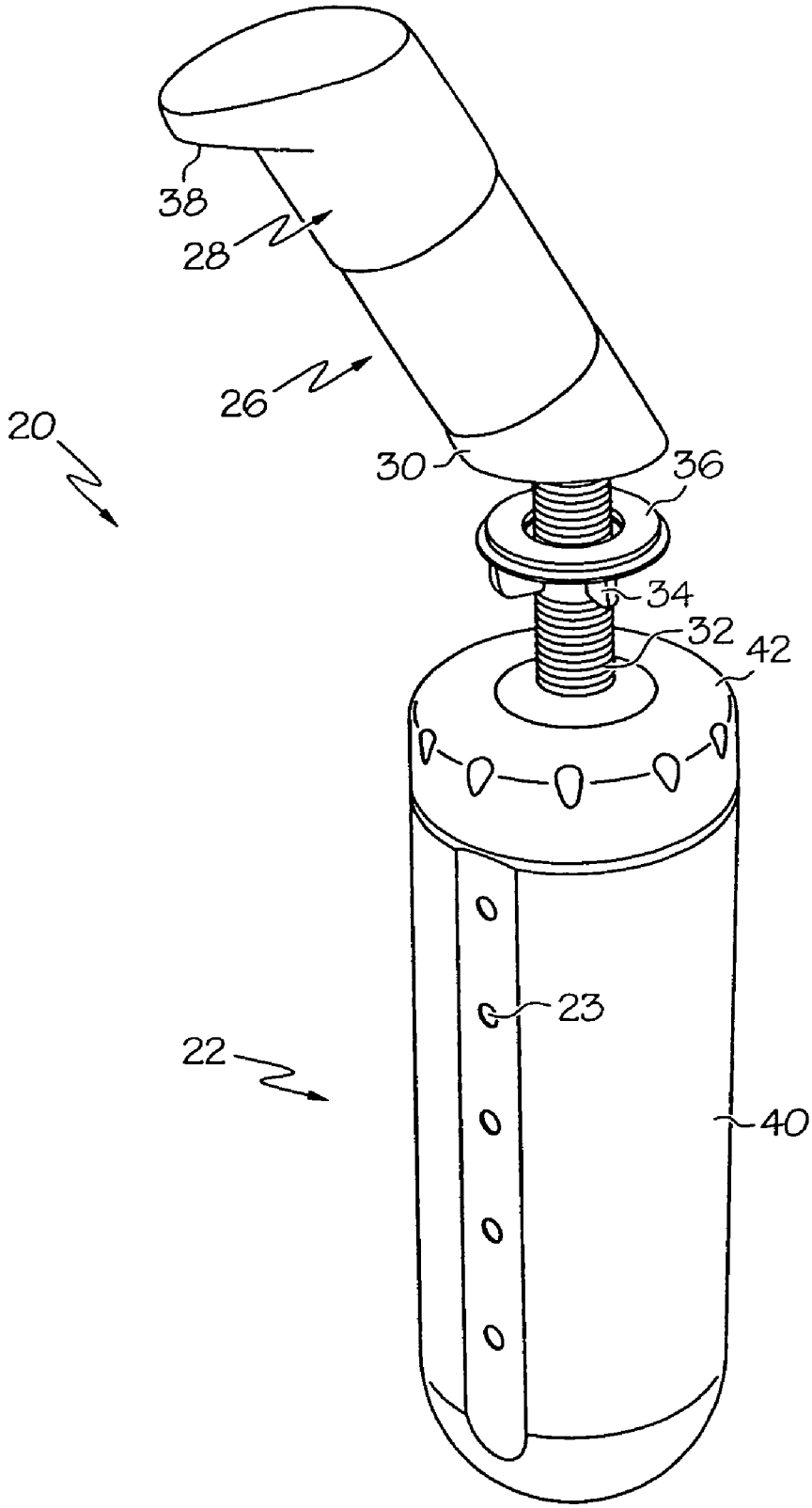
FIG. 1 is a perspective view of a product dispenser in accordance with one embodiment of the present invention.
Figure 7:
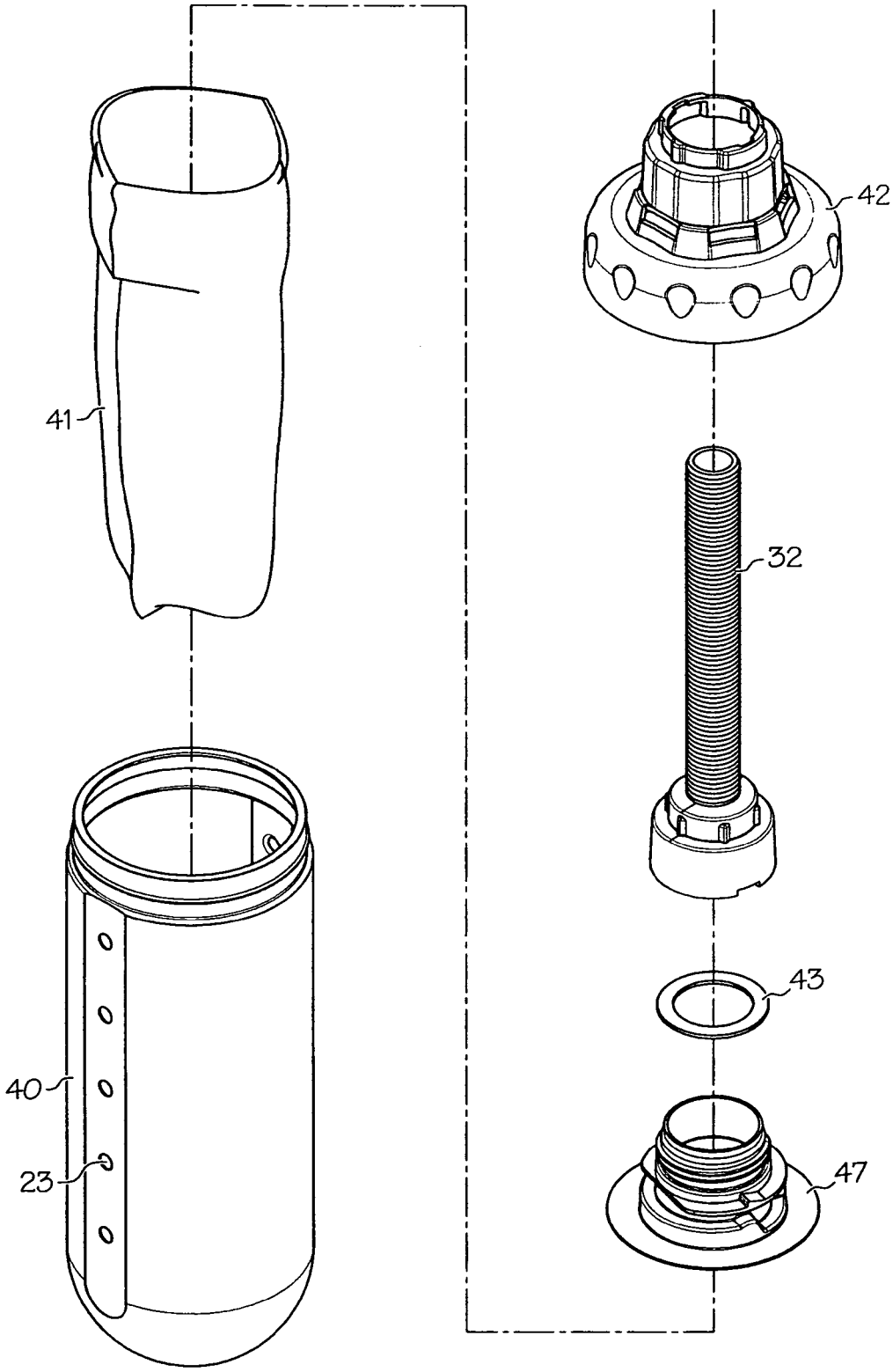
FIG. 7 is an exploded perspective view depicting a receptacle and associated components for use with the product dispenser of FIG. 1.

The product dispensing system can include a product dispenser. A product dispenser 20 in accordance with one embodiment of the present invention is depicted in FIG. 1. The product dispenser 20 includes a housing 26 and a receptacle 22. The receptacle 22 can store a product for dispensation, such as soap. It will be appreciated that the soap can comprise any of a variety of a specific forms, such as liquid or foam, for example. The receptacle 22 is shown to include a canister 40 and a lid 42, but can also include additional components such as are shown in FIG. 7 (e.g., a bag 41). Product can be dispensed from the receptacle 22, through a threaded shaft 32, and then into the housing 26. The housing 26, as will be discussed in further detail below, can include a pump to assist in extraction of product from the receptacle 22. The housing 26 can include a nozzle assembly 28 having a spout 38 to facilitate dispensation of the product.

Figure 2:
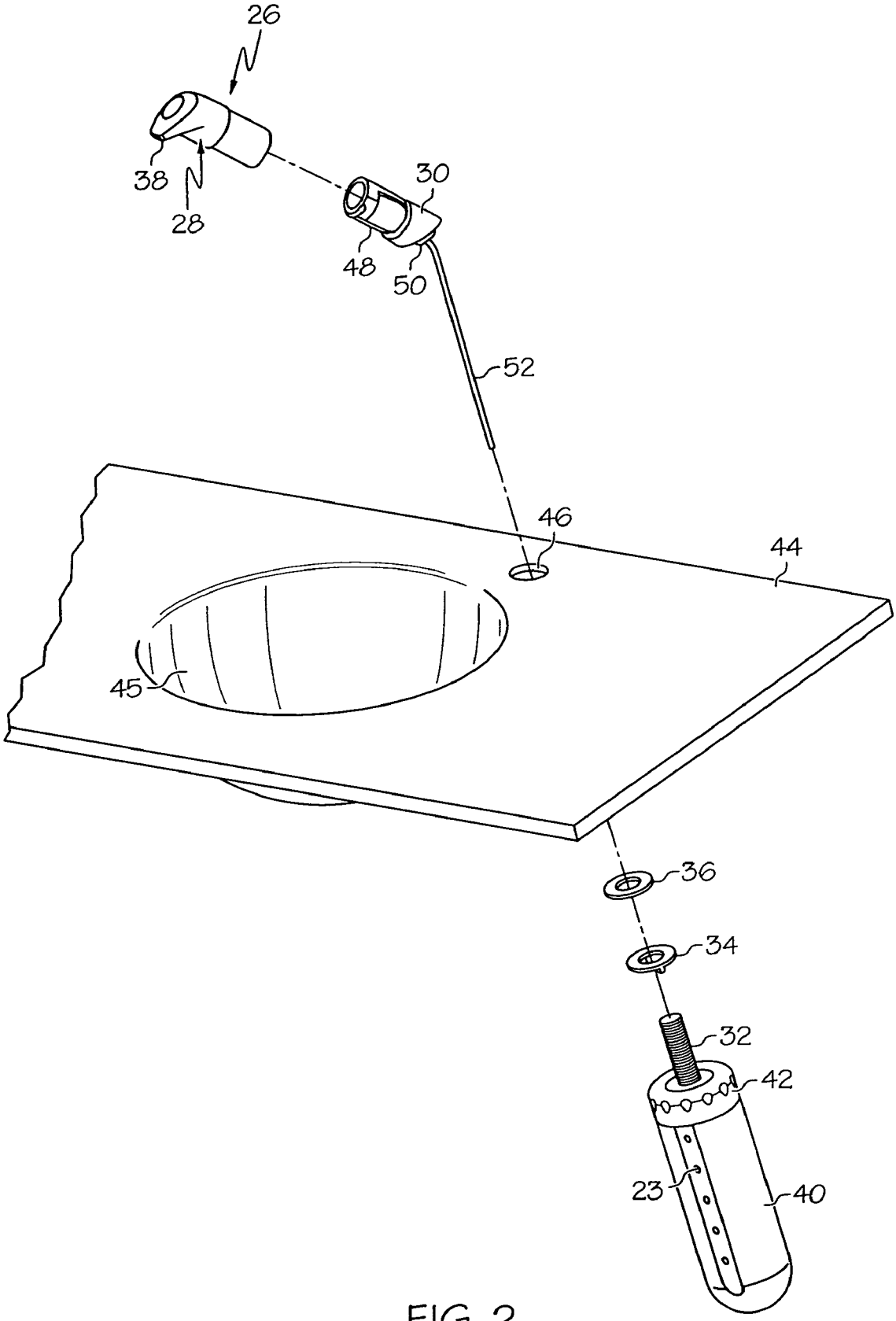
FIG. 2 is an exploded front perspective view of the product dispenser of FIG. 1 in association with a sink.
Figure 3:
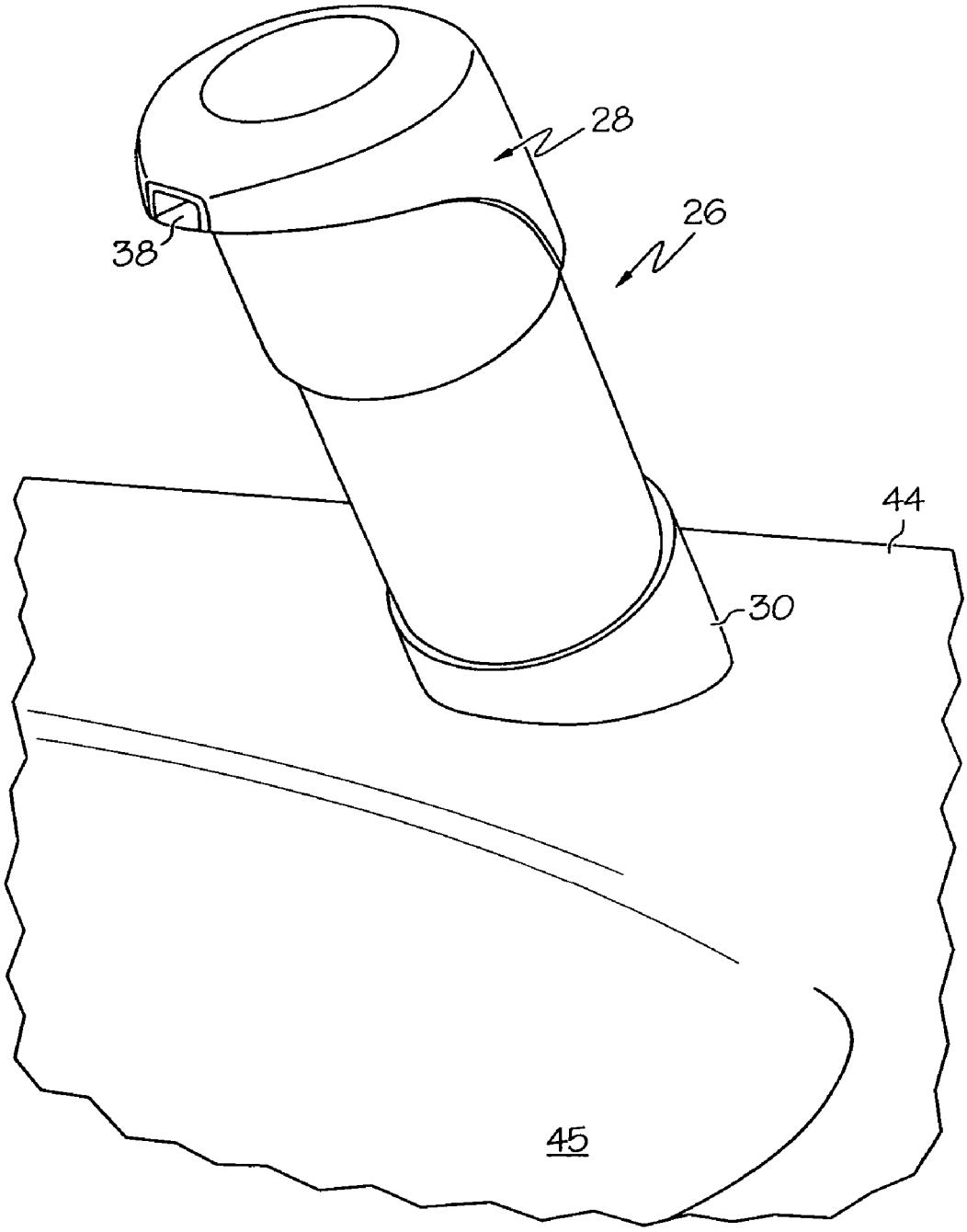
FIG. 3 is a front perspective view depicting the portion of the product dispenser of FIG. 2 which extends above the sink.
Figure 4:
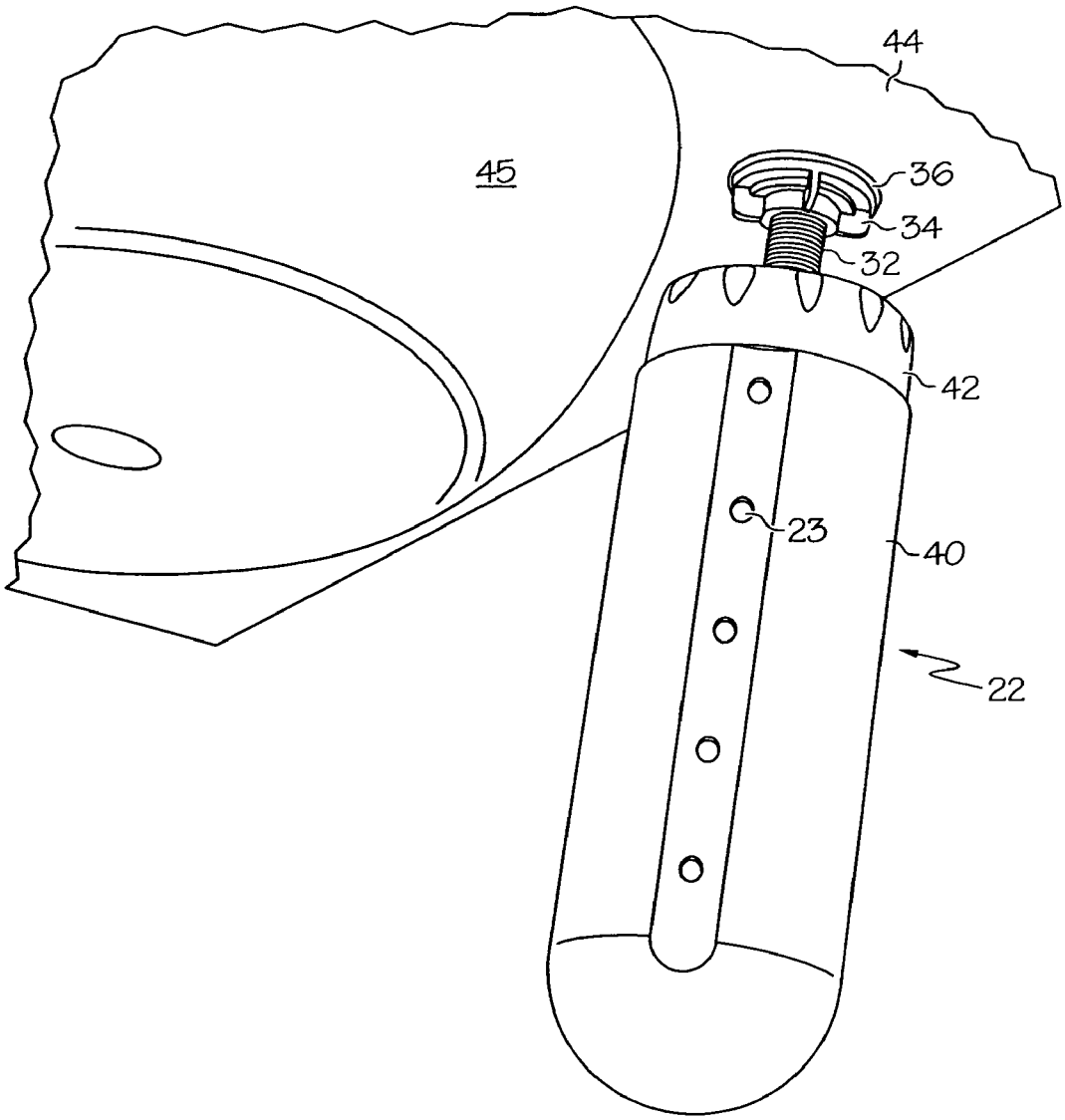
FIG. 4 is a bottom perspective view depicting the portion of the product dispenser of FIG. 2 which extends below the sink.

As shown in detail in FIGS. 2-4, the product dispenser 20 can be mounted to a countertop or sink 44 adjacent to a wash basin 45. In particular, the threaded shaft 32 can be inserted through a nut 34, a washer 36, a mounting aperture 46 in the sink 44, and then into a threaded aperture 50 of a base 30. Once inserted into the threaded aperture 50 in this manner, the nut 34 can be tightened, thereby drawing the base 30 close to the sink 44 so as to facilitate a tight and substantially immoveable relationship therebetween. It will be appreciated that the base 30 can be mountable to a sink, countertop, or any of a variety of other structures in a similar manner. A fill column 48 can be secured (e.g., by attachment) to the base 30 such that the fill column 48 is offset relative to the receptacle 22, and the fill column 48 can be provided in fluid communication with the receptacle 22. The housing 26 can selectively connect with the fill column 48.

Once the product dispenser is assembled (e.g., as shown in FIGS. 3-4), the nozzle assembly 28, when depressed by an operator, can cause product to be dispensed from the receptacle 22 and through the spout 38. In particular, when a product dispenser 20 is configured to dispense hand soap, an operator washing his or her hands can depress the nozzle assembly 28 such that hand soap will be forced from the spout 38 such as for application to the hands of the operator.

Figure 5:
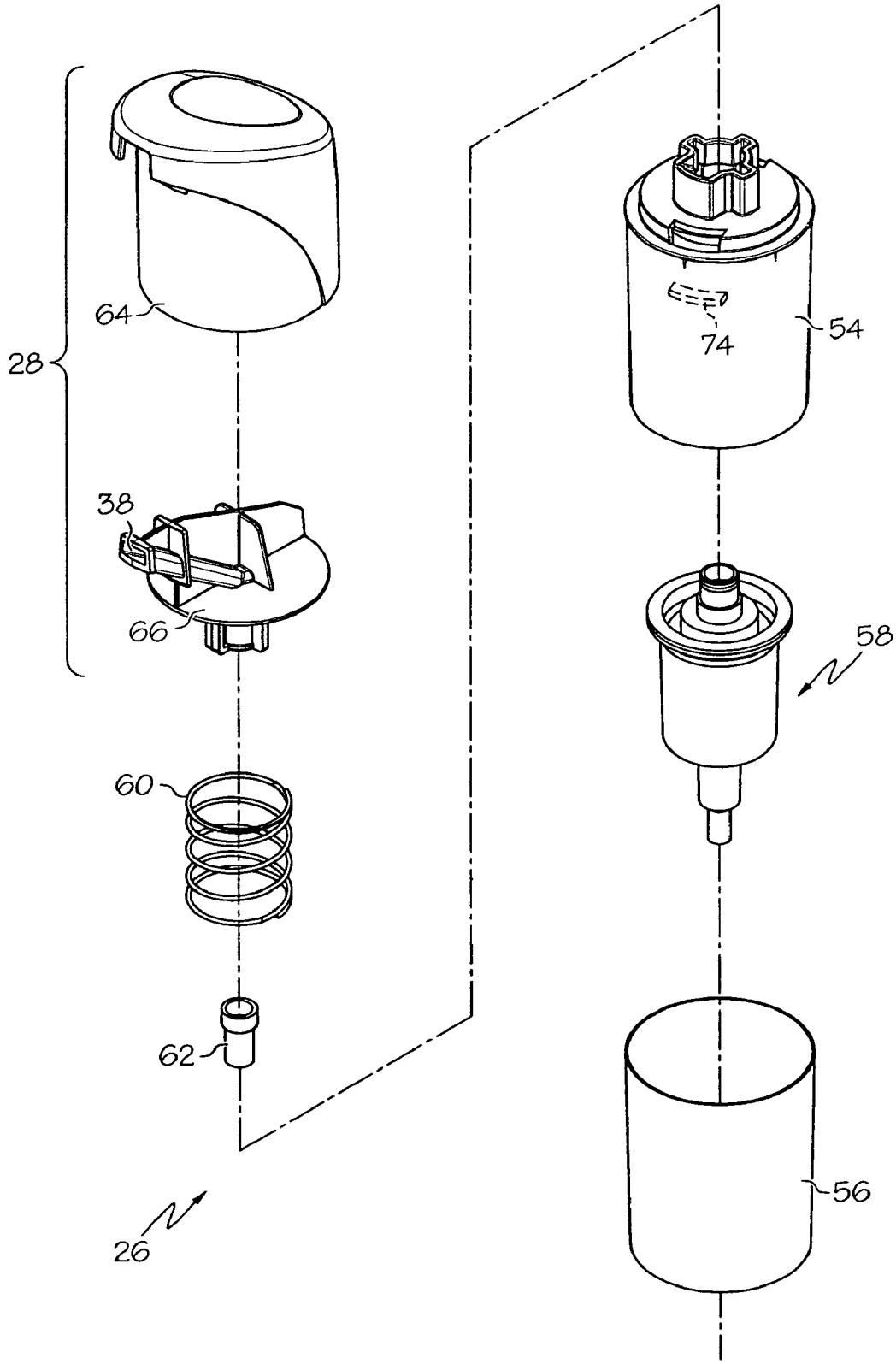
FIG. 5 is an exploded perspective view depicting components of the housing of the product dispenser of FIG. 1.
Figure 12:
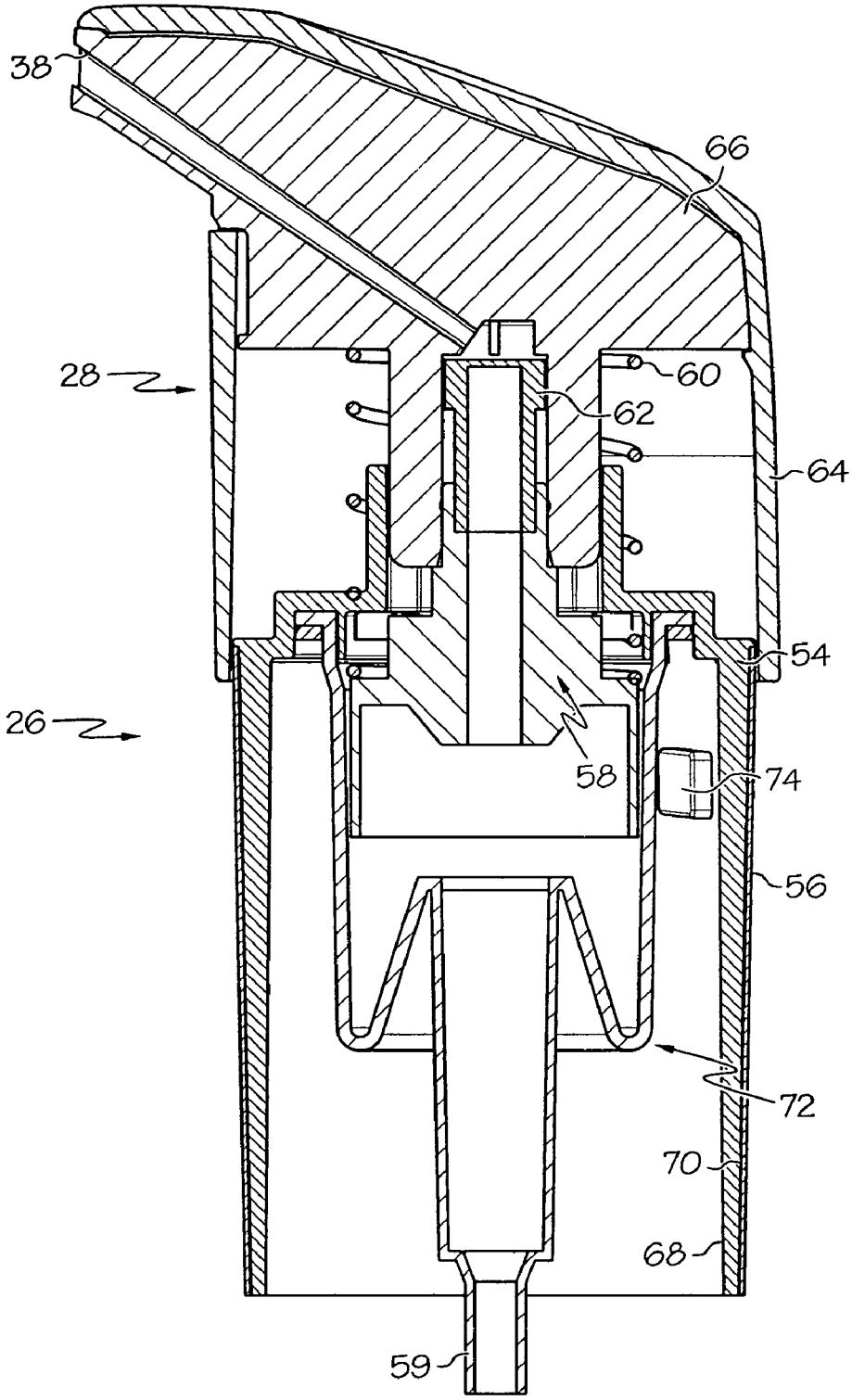
FIG. 12 is a cross-sectional view depicting the housing of FIG. 1 as assembled.

FIG. 5 depicts components which might be included within a housing made in accordance with one embodiment of the present invention. In particular, the housing 26 is shown to include the nozzle assembly 28, a spring 60, a screen assembly 62, an elongated ring 54, a pump assembly 58, and an outer ring 56. The nozzle assembly 28 is shown to include a nozzle cap 64 and a nozzle insert 66, and can be moveably secured to the elongated ring 54. The screen assembly 62 can comprise one or more screens (e.g., formed from plastic and/or metal) which can assist in causing product from the receptacle 22 to be foamed before being dispensed from the spout 38. FIG. 12 is a cross-sectional depiction of these components as assembled, wherein the elongated ring 54 of the housing 26 is shown to have inner circumference 68 and an outer circumference 70. The outer ring 56 can be positioned around the elongated ring 54 for decoration and/or structural support. A cavity 72 can be defined by the inner circumference 68 of the elongated ring 54, wherein the pump assembly 58 and/or other components can be positioned within this cavity 72. The housing 26 can include a tab (e.g., 74, shown in FIGS. 5 and 12) which can rotatably engage a housing mount (e.g., 97, 98, shown in FIGS. 16-17) of the fill column 48 so that the housing 26 may be selectively attached/removed from the fill column 48. It will be appreciated that a housing in accordance with the teachings of the present invention might alternatively involve fewer or more components arranged in any of a variety of suitable alternative configurations, and/or might selectively attach to the fill column in any of a variety of alternative configurations.

Figure 13:
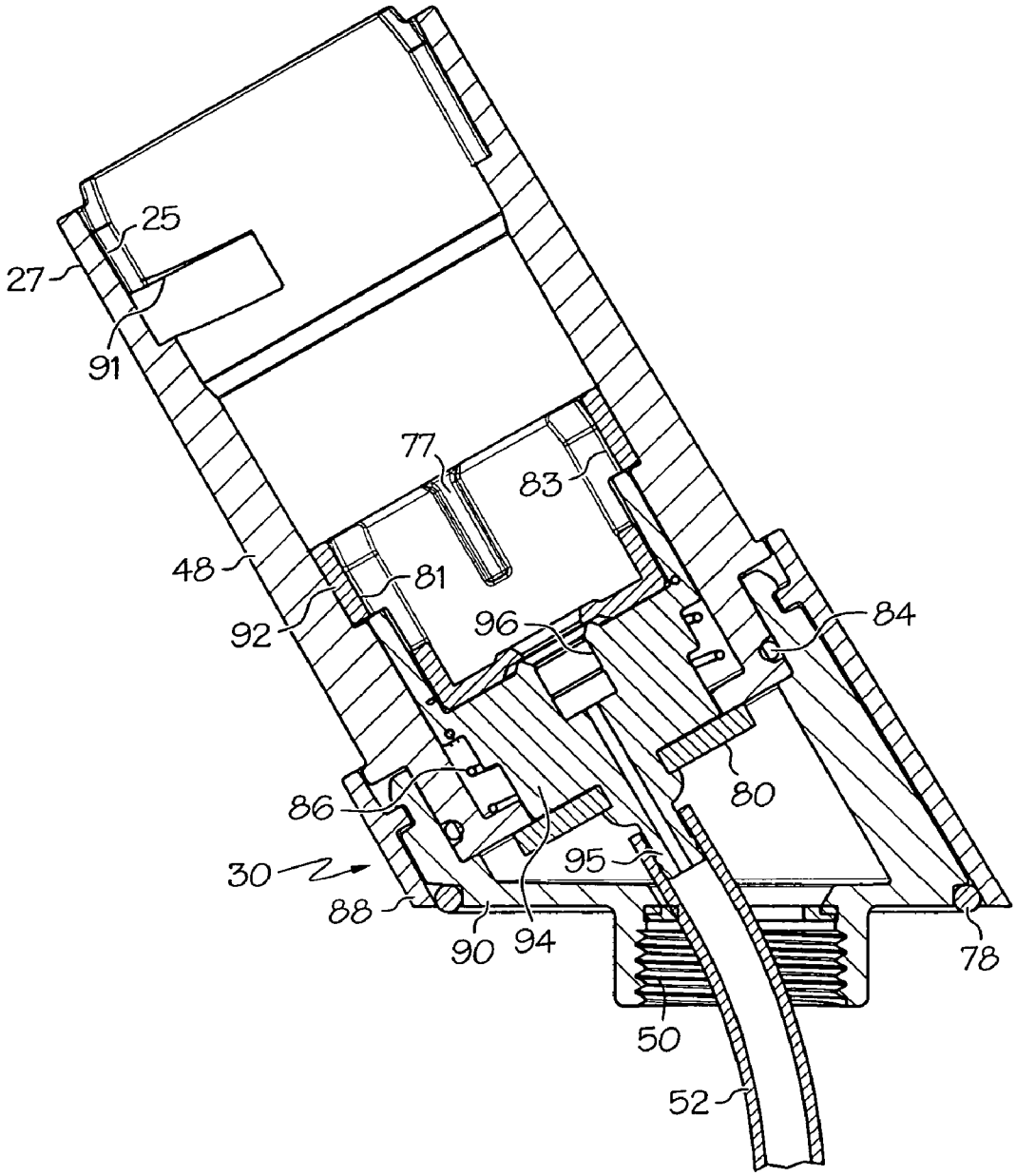
FIG. 13 is a cross-sectional view depicting the fill column and certain other components of FIG. 6 as assembled.
Figure 17:
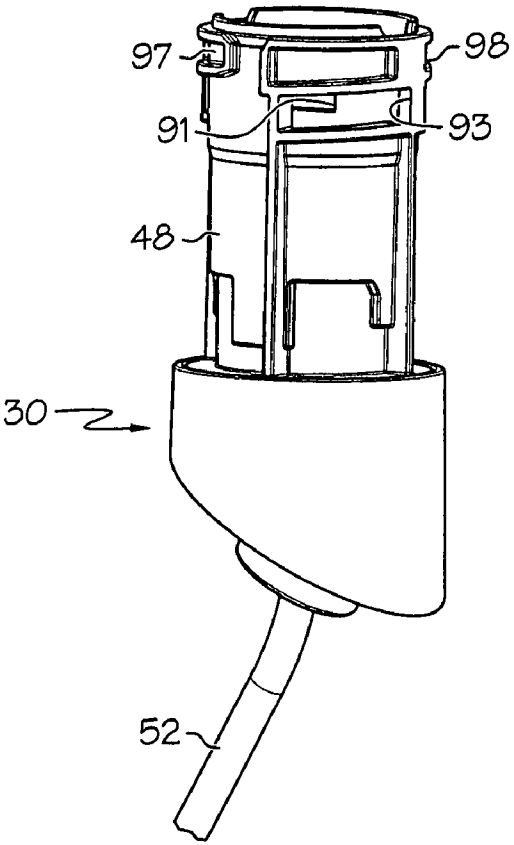
FIG. 17 is another side perspective view depicting the fill column and certain other components of FIG. 6 as assembled.
Figure 16:
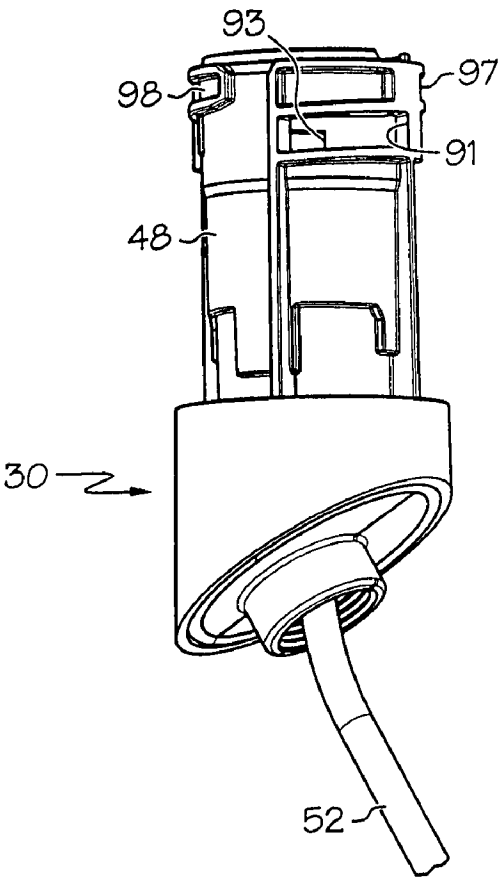
FIG. 16 is a side perspective view depicting the fill column and certain other components of FIG. 6 as assembled.

In the particularly depicted embodiment, the fill column 48 is shown have an outer periphery 27 and an inner periphery 25, as shown for example in FIG. 13. The outer periphery 27 can be configured for selective securement to the housing 26, and can therefore include a housing mount (e.g., 97, 98 as shown in FIGS. 16-17) for removably securing the housing 26 to the outer periphery 27 of the fill column 48. The inner periphery 25 can comprise one or more grooves (e.g., 91, 93, as shown in FIGS. 16-17) for removably receiving guide elements (e.g., 114, 115 in FIG. 11) of a cap assembly 104 of a refill dispenser 100 (shown in FIG. 8) so that the cap assembly 104 can be moved between the opened and closed positions upon rotation of a cap body 110 about the fill column 48, as discussed further below.

Figure 6:
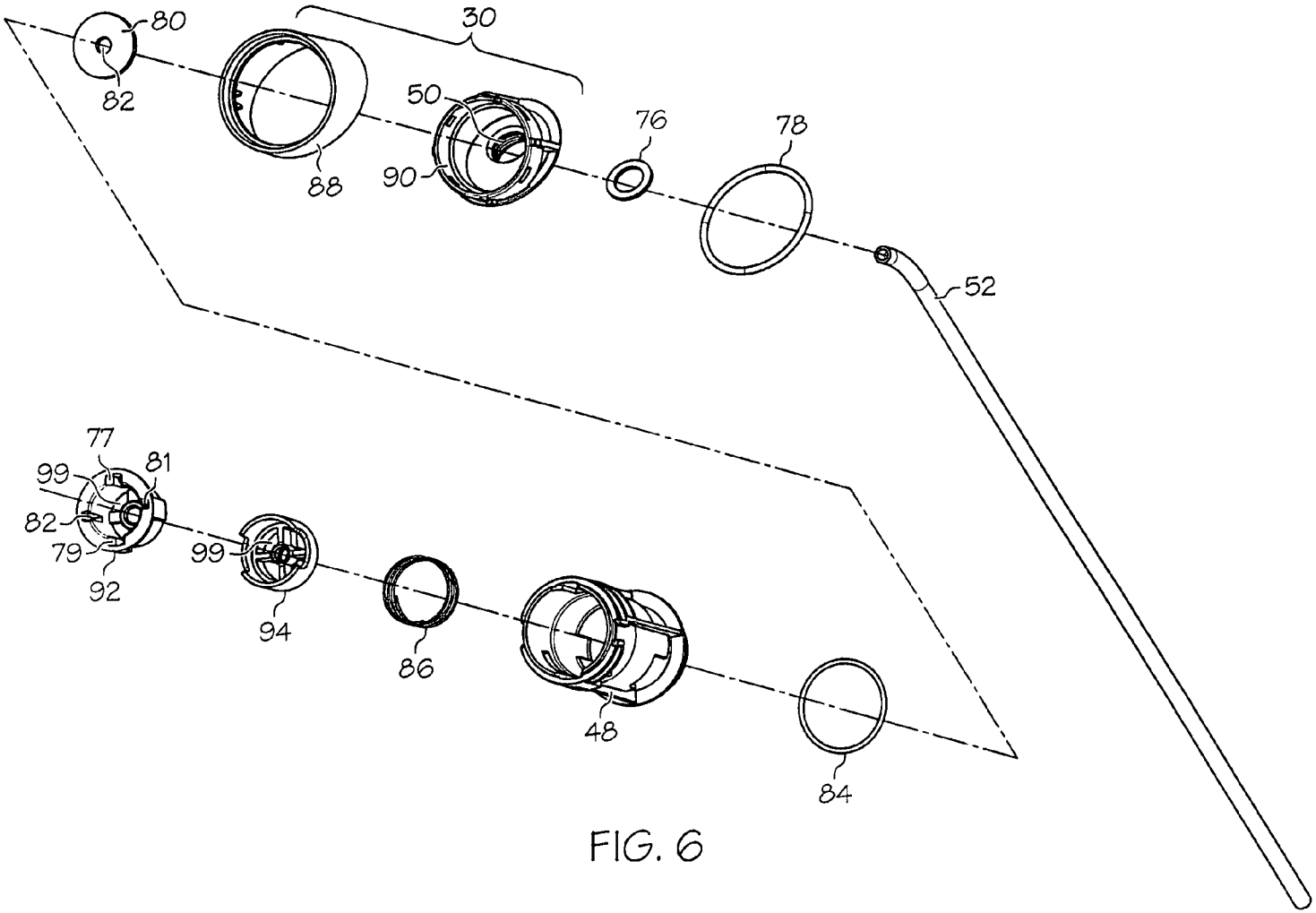
FIG. 6 is an exploded perspective view depicting the fill column, base and associated components of the product dispenser of FIG. 1.

The fill column 48 can be internally provided with an upper insert 92, a lower insert 94, and a spring 86, as shown in FIG. 6. Once these components are inserted into the fill column 48 (as shown in FIG. 13), the lower insert 94 can be generally biased against the upper insert 92 by the spring 86. It will be appreciated that the upper insert 92 and the lower insert 94, when seated within the fill column 48, can be prevented from rotation with respect to the fill column 48 by way of corresponding structures disposed upon the upper insert 92, the lower insert 94, and the fill column 48. The lower insert 94 can include an extension 95 which protrudes through an end of the fill column 48 and then through an aperture 82 of a washer 80.

The washer 80 can be secured upon the extension 95 and can have a larger diameter than an opening in the end of the fill column 48, such that, so long as the washer 80 remains in place upon the extension 95, the lower insert 94 can be prevented from escaping from the other end of the fill column 48.

Figure 14:
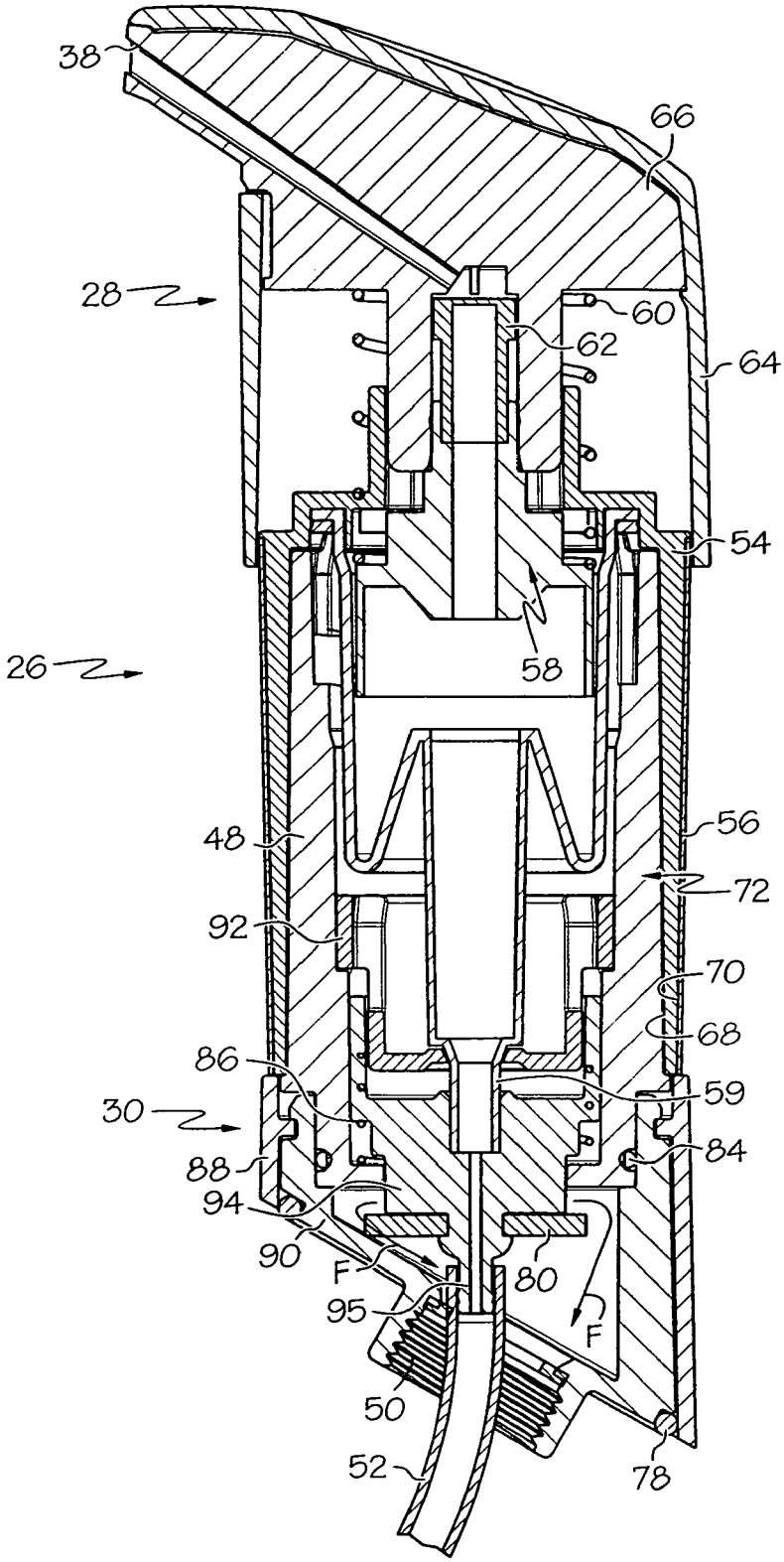
FIG. 14 is a cross-sectional view depicting the housing of FIG. 12 as attached to the fill column and other components of FIG. 13.
Figure 15:
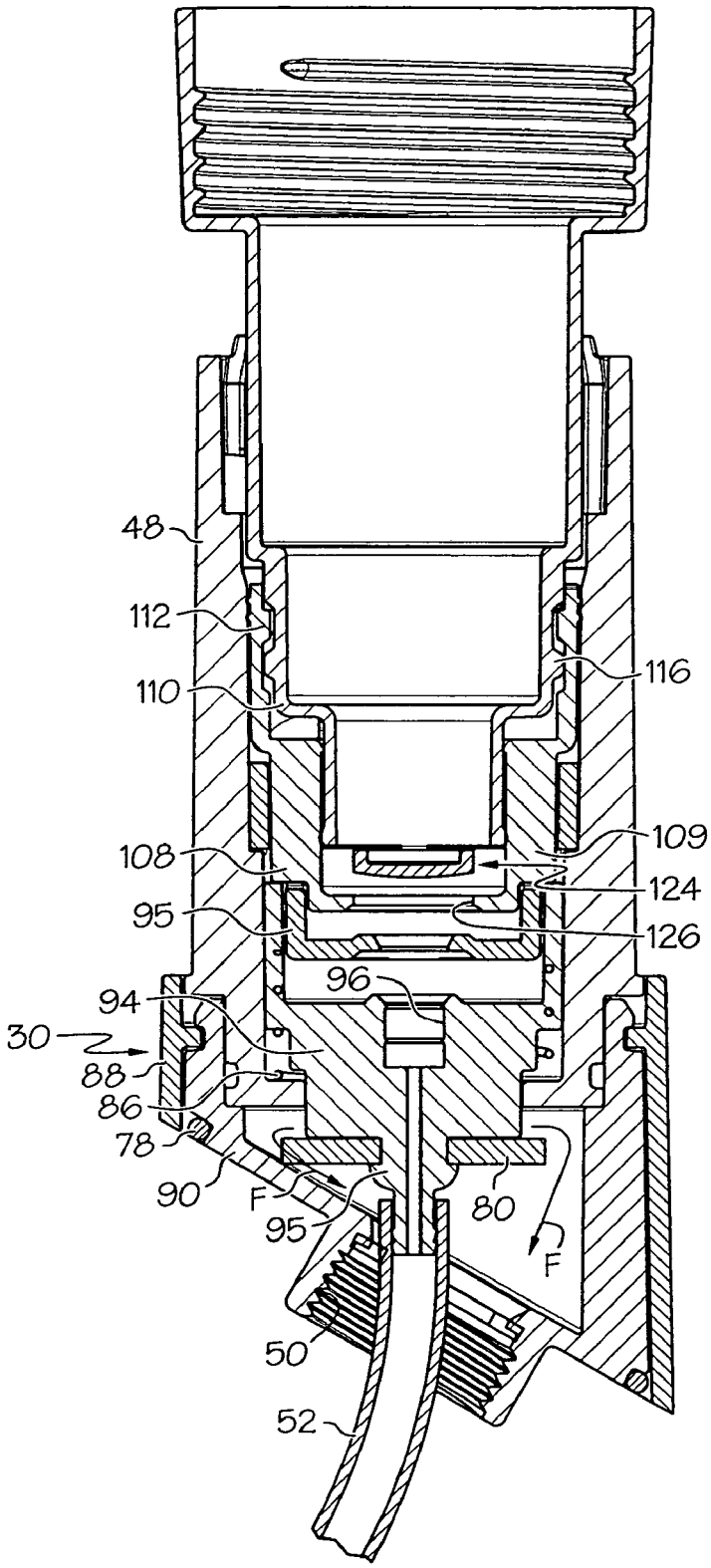
FIG. 15 is a cross-sectional view depicting the cap body and cap head of FIG. 11 in association with the fill column and other components of FIG. 13.

The washer 80 can also provide a valve arrangement and function, the state of which depends upon the axial position of the lower insert 94 within the fill column 48. In one particular embodiment, as shown in FIG. 15, the washer 80 can be configured to move into an opened state when the cap assembly 104 is fully seated with respect to the fill column 48, such that the receptacle 22 can be filled when the cap assembly is fully seated 104 with respect to (e.g., within) the fill column 48. The washer 80 may also be configured to move into an opened state (e.g., as shown in FIG. 14) when the housing 26 is attached to the fill column 48. However, when neither the cap assembly 104 nor the housing 26 interfaces the fill column 48, the washer 80 can assume a closed state, as shown in FIG. 13. In this manner, the fill column 48 can be configured to selectively prohibit passage of product from a refill dispenser (e.g., 100 described below) to the receptacle 22. It will be appreciated that other valve arrangements (which may or may not include the washer 80) might alternatively be associated with a fill column to facilitate selective access of product to and/or from the receptacle 22.

A tube 52 can then be attached to the extension 95. The tube 52 can be configured to receive product from the receptacle 22 for dispensation, and in some circumstances might assist in refilling the receptacle 22. A check-type valve (not shown) can be attached, inserted, or otherwise associated with the tube 52 (e.g., near the distal or lower end of the tube 52). This check-type valve can help to maintain priming of the pump assembly 58 and resultant suction within the tube 52, even during extended periods of non-use. It will be appreciated that when the washer 80 is in the closed state and the tube 52 is provided with a check-type valve, refilling of the receptacle 22 from above the sirk or countertop can be prohibited. Once these components are assembled, the fill column 48 can be attached to the base 30.

Figure 18:
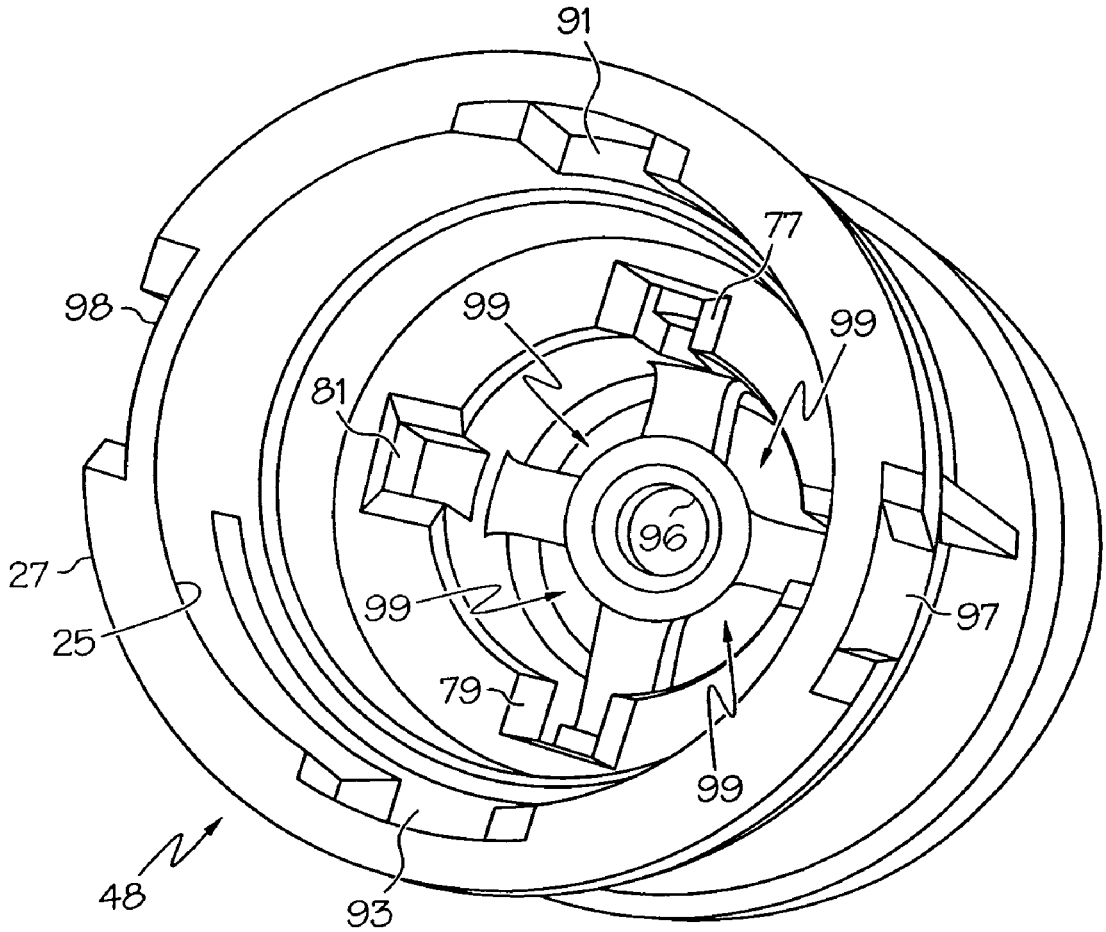
FIG. 18 is a perspective view depicting the fill column of FIGS. 2, 6, and 13-17.

The fill column 48 can comprise one or more channels (e.g., provided in the upper insert 92) for removably receiving the flange element(s) present on a cap head of a refill dispenser. For example, major channels 77 and 79 and minor channels 81 and 83 can be provided within the fill column 48, as shown in FIGS. 13 and 18, for example. The channels can be configured such that any flange element(s) on a cap head can be moveably secured such that the cap head can move axially from the cap body but cannot rotate within the fill column upon rotation of the cap body about the fill column.

Referring again to FIG. 6, the base 30 can comprise a base cover 88 and a base insert 90. In one embodiment of the present invention, the base insert 90 might be removably attached to the base cover 88 and an o-ring 78 or other seal might be provided to assist in maintaining this attachment. In another embodiment, however, the base 30 might simply be provided as a single, integral component. In either embodiment, the fill column 48 can be attached to the base 30 and an o-ring 84 or some other seal might be provided to assist in this attachment. It will be appreciated, however, that the fill column might alternatively be formed integrally with the base. A gasket 76 can be provided to assist in providing a seal between the threaded shaft 32 and the threaded aperture 50 in the base insert 90.

The receptacle 22 can be formed in any of a variety of configurations. In one particular embodiment, as shown in FIG. 7, the receptacle 22 can comprise a bag 41 which is configured for insertion within the canister 40. A collar 47 can mate with the top portion of the bag 41, and a gasket 43 can be provided to assist in providing a sealed connection between the collar 47 and the threaded shaft 32. The threaded shaft 32 can then pass through the lid 42 of the receptacle 22, and the lid 42 can be permanently attached (e.g., with adhesive) or removably attached (e.g., screwed or snapped) onto the canister 40 so as to fully enclose the bag 41 within the receptacle 22. Product can then be withdrawn from the bag 41 or inserted into the bag 41 by way of the threaded shaft 32.

It will be appreciated that provision of a bag (e.g. 41) within the canister 40 as described with respect to FIG. 7 can provide certain advantages. In particular, a bag provides a collapsible product reservoir which facilitates escape of product therefrom (e.g., during soap dispensation) without any need for receipt of air into the bag, and furthermore facilitates receipt of product (e.g., during refilling) without any need for evacuation of air from the bag. Accordingly, by providing a bag within the canister, the canister can be refilled with product more quickly than if a bag were not provided within the canister, and additionally, product will be less likely to foam during the refill process because of the lack of evacuating air. When a bag is provided within the canister, as shown in FIG. 7, one or more air holes (e.g., 23) can be provided to prevent pressurization of the canister as the volume of the bag changes (during insertion or removal of product to/from the bag). However, it will furthermore be appreciated that a receptacle in accordance with the present invention might not comprise a flexible bag (e.g., 41), but may rather involve product being directly contained within a canister (e.g., 40).

Figure 8:
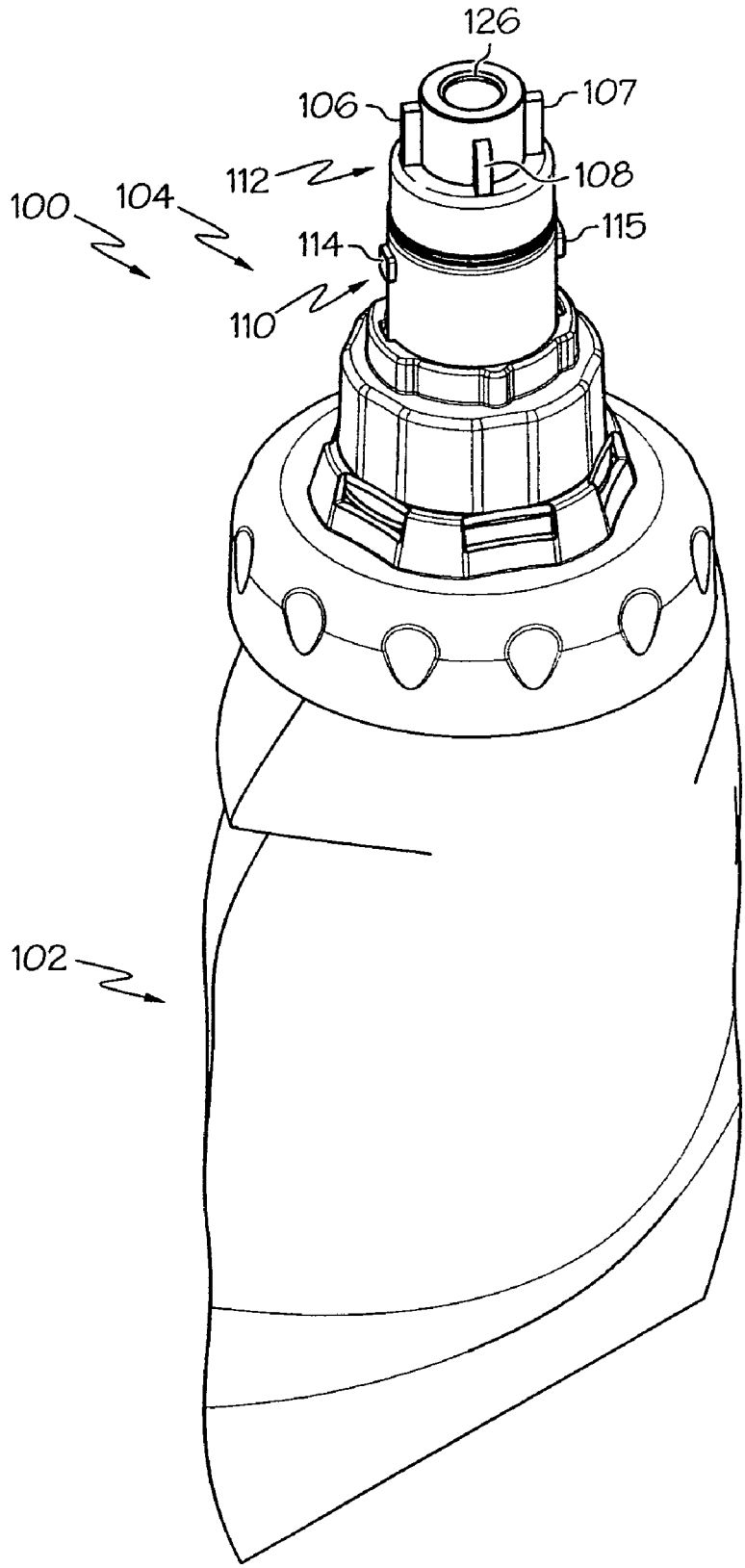
FIG. 8 is a perspective view depicting a refill dispenser in accordance with one embodiment of the present invention.
Figure 9:
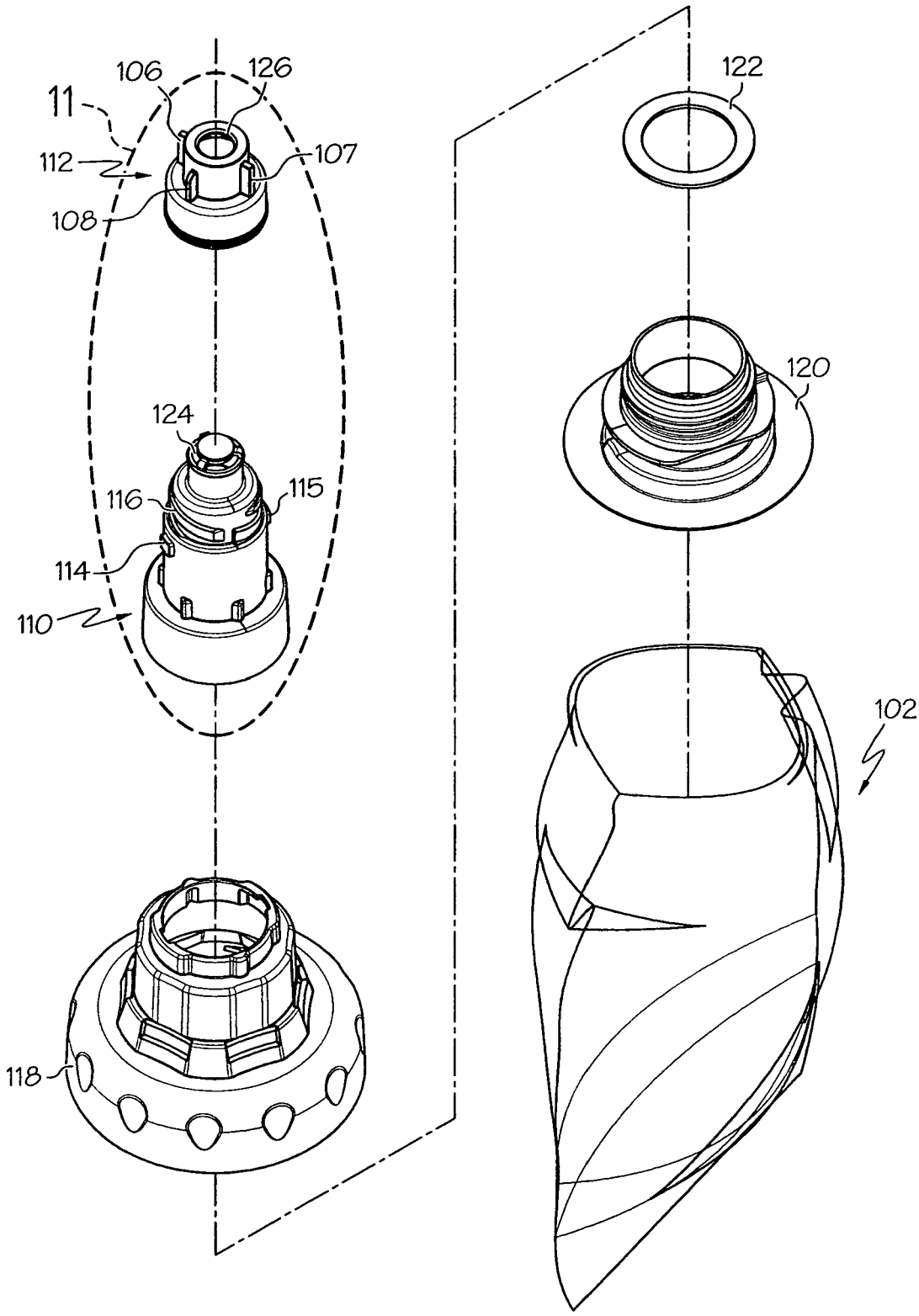
FIG. 9 is an exploded perspective view depicting the refill dispenser of FIG. 8.
Figure 10:
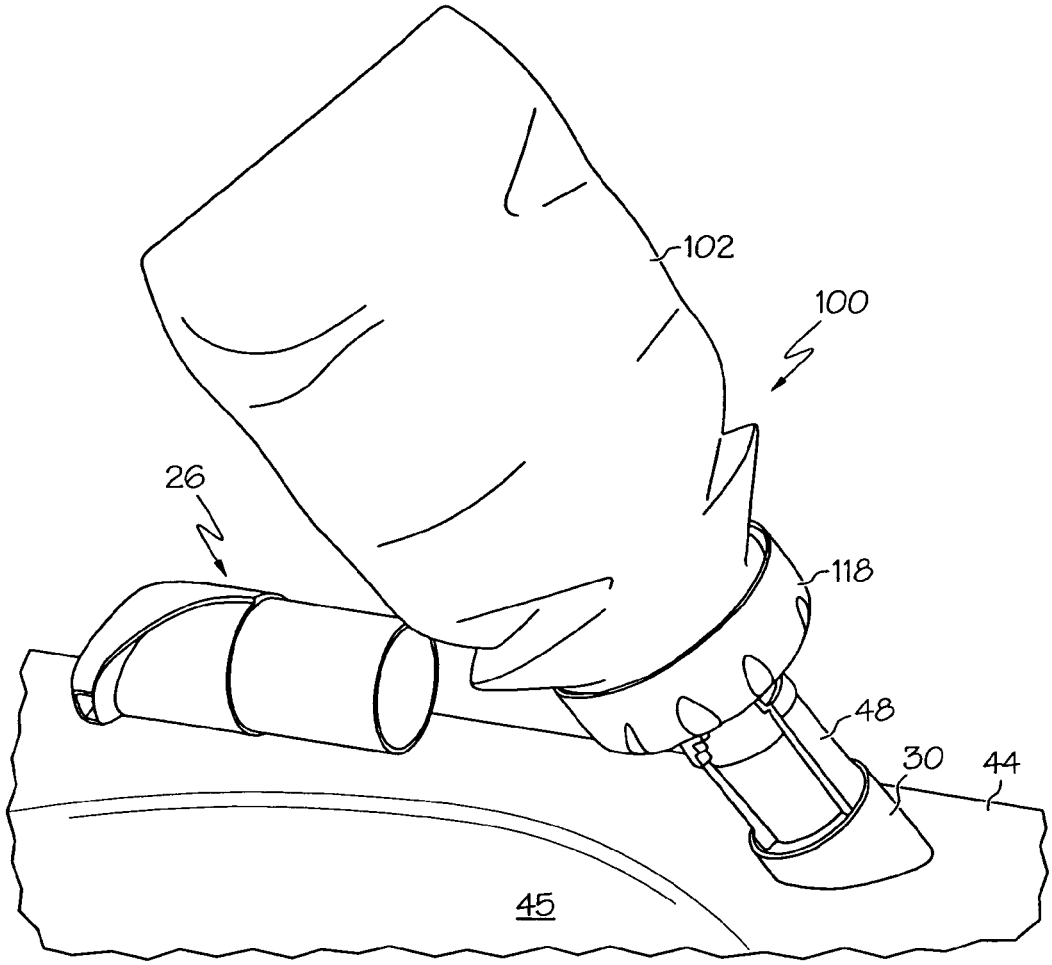
FIG. 10 is a perspective view depicting the housing of the product dispenser resting upon the sink while the refill dispenser of FIG. 8 is coupled with the product dispenser of FIG. 1.

The product dispensing system can also include a refill dispenser. A refill dispenser can serve as a portable product storage container which can be used to periodically and selectively transfer a product such as to replenish the supply of the product within a product dispenser (e.g., 20). In one particular embodiment of the present invention, the refill dispenser can store soap. A refill dispenser 100 in accordance with the teachings of the present invention can include a container 102 and a cap assembly 104, as shown in FIG. 8. Although the container 102 is depicted as comprising a flexible bag, it will be appreciated that the container might alternatively comprise a rigid or semi-rigid container. As shown most clearly in FIGS. 8 and 9, the cap assembly 104 can comprise a cap body 110, a cap head 112, collars 118 and 120, and a gasket 122. The collars 118, 120 and the gasket 122 can assist in securing the cap body 110 to the container 102. The cap assembly 104 is shown in FIG. 8 to extend adjacent to the container 102 and can be moveable between a closed position and an opened position. The cap head 112 can be mounted to the cap body 110 and can be rotatable with respect to the cap body 110 for selectively moving the cap assembly 104 between the opened position and the closed position. The opened position is sometimes referred to herein as a fill position because the refill dispenser 100 can dispense product to fill a receptacle when the cap assembly 104 is in its opened position.

It will be appreciated that a refill dispenser in accordance with the teachings of the present invention may be disposable, non-disposable or partially disposable. In particular, a disposable refill dispenser may be purchased by a consumer while full of product, but then disposed of when its product has been fully released (i.e., through replenishment of product dispenser 20). A non-disposable refill dispenser might similarly be purchased while full of product, but might alternatively be purchased by a consumer before being filled with product. Such a non-disposable refill dispenser could then be filled and/or refilled by a consumer at will. A partially disposable refill dispenser might comprise a container (e.g., 102) which is purchasable by a consumer while full of product, whereby the container is provided with a collar (e.g., 120) having a removable seal or cap (not shown), but the remaining portion of the cap assembly 104 could be interchangeable among containers and therefore not be disposable, such that only the container (and possibly a collar and/or seal or cap) may be disposable.

Figure 11:
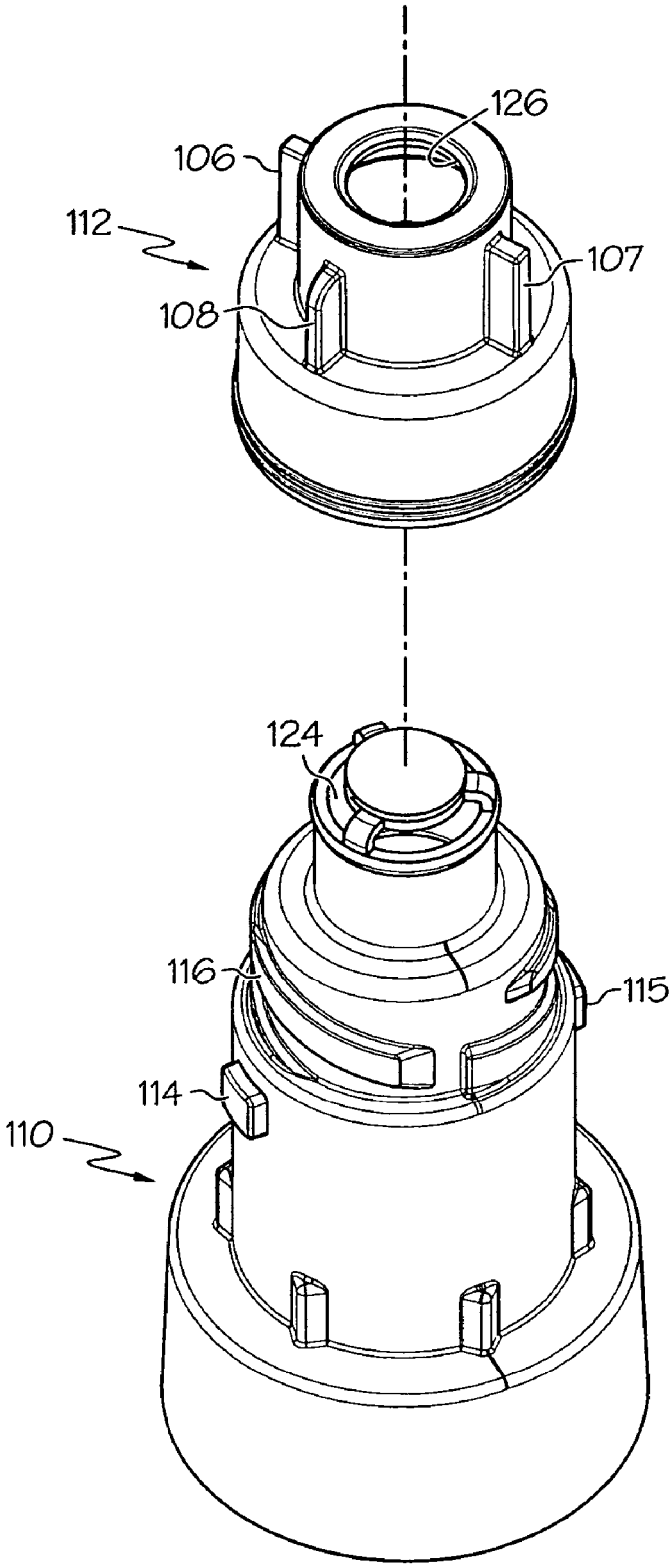
FIG. 11 is an enlarged perspective view depicting the cap body and cap head of the refill dispenser of FIG. 8.

Referring to FIG. 11, the cap body 110 can include a metering portion 116 and the cap head 112 can be mounted to the metering portion 116 such that the cap head 112 can rotate about the metering portion 116 between its opened and closed positions. The metering portion can comprise one or more grooves, protrusions, or other feature(s) of the can body 110 which interface with the cap head 112 and which facilitate axial movement of the cap head 112 during rotational movement of the cap head 112 so that the cap head 112 moves between opened and closed positions. In one particular embodiment, the metering portion 116 can comprise a protrusion which extends helically along the cap body 110 (as shown in FIG. 11) and which facilitates a rotatable screw-type connection between the cap head 112 and the cap body 110. In other embodiments, the metering portion can comprise multiple such protrusions.

The cap head 112 can also include one or more flange elements which can be used to facilitate turning of the cap head 112 with respect to the cap body 110. In one particular embodiment, the cap head 112 can include major flange elements 106 and 107 as well as minor flange elements 108 and 109, any or all of which can extend outwardly from the cap head 112 and can be used to facilitate turning of the cap head 112 with respect to the cap body 110. In another embodiment, a cap head might only include a single flange element.

Guide elements 114 and 115 can project or extend outwardly from the cap assembly 104, such as from the cap body 110 as shown in FIG. 11. Although two guide elements 114 and 115 are depicted, it will be appreciated that fewer or more guide elements could be provided upon the cap body 110. In one embodiment, the major flange elements 106, 107 and the guide elements 114, 115 are axially aligned when the cap head 112 is in the closed position (e.g., as generally shown in FIG. 8). The guide element(s) can be configured to removably secure the cap body to one or more grooves of a fill column so that the cap head can be axially displaced from the cap body (as discussed below) upon rotation of the cap body about the fill column. In another particular embodiment, a cap assembly might be provided with only a single guide element, wherein this guide element can be configured to interface a groove present upon (e.g., within an interior cavity of) a fill column such that, upon rotation of the cap assembly with respect to the fill column, the cap assembly becomes seated with respect to the fill column and opens such that product may be dispensed into the fill column.

The cap body 110 can be provided with one or more apertures (e.g. 124) to facilitate passage of product outwardly therefrom and from the container 102. The cap head 112 can also be provided with an aperture 126, wherein the aperture 126 can facilitate passage of product outwardly therefrom provided that the cap head 112 is in the opened position.

Use of the product dispenser system will now be described. At some point after the product dispenser 20 is installed upon a sink 44, it will become necessary to replenish product within the receptacle 22. In order to do so, the housing 26 can be removed from the fill column 48. In one embodiment of the present invention, this can be accomplished by rotating the housing 26 with respect to the fill column 48. By rotating the housing 26 with respect to the fill column 48, one or more tabs (e.g. 74 as shown in FIG. 12) provided on an inner circumference 68 of the elongated ring 54 can be caused to disengage one or more housing mounts (e.g. 97, 98 shown in FIGS. 16-17) provided upon the fill column 48 such that the housing 26 may be removed from the fill column 48.

Once the housing 26 is removed from the fill column 48, the refill dispenser 100 can be attached to the fill column 48. In one particular embodiment of the present invention, the fill column 48 can be configured to interiorly receive at least a portion of the cap assembly 104 of the refill dispenser 100, as shown for example in FIGS. 10 and 15. In particular, in order to insert the refill dispenser 100 into the fill column 48, the guide elements 114 and 115 on the cap body 110 can be aligned with grooves 91 and 93 disposed upon an inner periphery 25 of the fill column 48. Once this alignment is achieved, the cap body 110 and the cap head 112 can then be longitudinally inserted a short distance axially into the fill column 48. When the guide elements 114 and 115 of the cap body 110 begin axial movement into the fill column 48, one or more major flange elements 106, 107 present upon the cap head 112 begin axial insertion into major channels 77 and 79 disposed within the fill column 48. Minor flange elements 108 and 109 might also be present upon the cap head 112, in which case those minor flange elements 108 and 109 may also be axially received within minor channels 81 and 83 disposed within the fill column 48.

After passing axially into the fill column 48, the cap body 110 can rotate with respect to the fill column 48 as the guide elements 114 and 115 continue to progress through the grooves 91 and 93. In this manner, the guide elements 114 and 115 can be removably received in grooves 91 and 93 of the fill column 48 so that the cap assembly 104 may be moveably secured within the fill column 48. In one embodiment, this continued progression through the grooves 91 and 93 comprises helical motion, thereby causing the cap body 110 and cap head 112 to be further axially drawn into the fill column 48. When the cap body 110 is positioned within the fill column 48 and is then rotated in this manner, the cap head 112 does not rotate with respect to the fill column 48, and is thereby unscrewed or axially displaced along the metering portion 116 from the cap body 110 such that the cap head 112 moves axially into the fill column 48. Accordingly, once the cap assembly 104 is rotated about and into final position within the fill column 48, the cap assembly 104 is moved into the fill position so that product may be transferred or dispensed from the container 102 to the receptacle 22.

It will be appreciated that, in this configuration, the refill dispenser 100 can be prevented from dispensing product into the fill channel 48 until such time as the cap assembly 104 is fully or substantially fully seated with respect to the fill column 48 (e.g., as shown in FIG. 15). Hence, it is unlikely that excess product will be caused to accumulate within the fill column due to overfilling of the fill column and/or misaiming of the refill dispenser. In particular, requiring movement of the cap head 112 toward the bottom of the fill column 48 before allowing dispensation of product from the cap assembly 104 helps to prevent product from squirting or otherwise escaping around the perimeter of the cap head 110 and outwardly from the fill column 48. Also, it will be appreciated that a cap assembly can have a close or tight circumferential relationship with a fill column in order that, during coupling between the fill column and refill dispenser, product will not escape from the interface between the fill column and refill dispenser. For example, in the particular embodiment depicted in FIG. 15, it can be seen that the cap body 110 sufficiently closely engages an inner periphery (25, shown in FIG. 18) of the fill column 48 such that inadvertent escape of product is unlikely. Also, as shown in FIG. 15, it can be seen that the cap head 112 is sufficiently tightly oriented within the fill column 48 such that inadvertent escape of product is unlikely. Additionally, one or more guide element(s), metering portion(s) and/or flange element(s) can maintain the cap head seated with the fill column during product dispensation from a refill dispenser, thereby substantially preventing inadvertent release of product. For example, in the example of FIGS. 11 and 15, guide elements 114 and 115 can perform this function.

Insertion of the cap assembly 104 in this manner into the fill column 48 can cause axial movement of the lower insert 94 such that the washer 80 is displaced, thereby resulting in passage of product along path "F" (shown in FIG. 15) and through openings 99 (depicted in FIGS. 6 and 18). Because the receptacle 22 is in fluid communication with the fill column 48, the receptacle 22 can receive product from the container 102 when the cap assembly 104 is in the opened position.

Once the receptacle 22 is filled, the cap assembly 104 can be rotated in an opposite direction, such that the guide elements 114 and 115 move within grooves 91 and 93. During this rotation, the cap head 112 remains rotationally stationary with respect to the fill column 48, and is therefore caused to be tightened with respect to the cap body 110, accordingly resulting in the sealing of apertures 124 and 126. After the rotation is complete, the refill dispenser 100 can be axially withdrawn from the fill column 48.

After removal of the cap assembly 104 from the fill column 48, the lower insert 94 can be biased upwardly by the spring 86 such that the washer 80 prevents passage of fluid and/or air through the openings 99 (e.g. as shown in FIG. 13). The housing 26 can then be reinserted onto the fill column 48, as shown for example in the cross-sectional view of FIG. 14. When the housing 26 is installed upon the fill column 48, a pump outlet 59 of the pump assembly 58 can be slidingly received into an orifice 96 in the lower insert 94 (see FIGS. 13-14). In some embodiments, installation of the housing 26 upon the fill column 48 can cause axial movement of the lower insert 94 such that the washer 80 is displaced, thereby allowing any remaining product residue in the fill column 48 to pass into the receptacle 22 along path "F" (shown in FIG. 14) and through openings 99 (depicted in FIGS. 6 and 18).

Accordingly, upon rotation of at least a portion of the cap assembly 104 about the fill column 48, at least a portion of the cap assembly 104 is configured to be axially displaced within the fill column 48 between the closed and opened positions. In particular, the cap assembly 104 can move between the opened and closed positions when the cap head 112 displaces axially from the cap body 110 within the channel of the fill column 48 which results from rotation of the cap body 110 about the fill column 48. When the cap head 112 is moved between the opened and closed positions, the flange element (s) (e.g., 106, 107, 108 and 109) of the cap head (112) is/are configured for axial movement within the channel(s) (e.g., 77, 79, 81, 83) of the fill column.

It will be appreciated that a product dispensing system in accordance with the teachings of the present invention can involve a fill column that is configured to interface a housing (e.g., 26) and a refill dispenser (e.g., 100) in any of a variety of alternative configurations. For example, in one alternate embodiment, both a housing and a refill dispenser can selectively interface a fill column by interfacing the fill column about the exterior of the fill column. In another embodiment, a product dispensing system can involve both a housing and a refill dispenser which can selectively interface a fill column by interfacing the interior of the fill column. In still another embodiment, a product dispensing system in accordance with the teaching of the present invention can involve a housing (e.g., 26) which selectively interfaces a fill column by interfacing the interior of a fill column, wherein a refill dispenser selectively interfaces the fill column by interfacing the fill column about the exterior of the fill column.

A product dispensing system in accordance with the teachings of the present invention can facilitate easy and efficient refilling, and is accordingly suitable for new installations and to replace existing conventional soap dispensers. By virtue of being fillable from above the sink or counter, it is not necessary for a custodian to reach or otherwise access areas beneath the sink. Furthermore, spilling of soap during the refilling process is virtually eliminated.

The foregoing description of embodiments and examples of the invention has been presented for purposes of illustration and description. It is not intended to be exhaustive or to limit the invention to the forms described. Numerous modifications are possible in light of the above teachings. Some of those modifications have been discussed and others will be understood by those skilled in the art. The embodiments were chosen and described in order to best illustrate the principles of the invention and various embodiments as are suited to the particular use contemplated. The scope of the invention is, of course, not limited to the examples or embodiments set forth herein, but can be employed in any number of applications and equivalent devices by those of ordinary skill in the art. Rather it is hereby intended the scope of the invention be defined by the claims appended hereto.

What is claimed is:

1. A refill dispenser comprising:

a container configured to hold a product;

a cap assembly extending adjacent to said container and having a fill position; and a guide element provided upon said cap assembly, said guide element removably received in a groove of a fill column so that said cap assembly may be moveably secured within said fill column;

wherein, upon rotation of said cap assembly, at least a portion of said cap assembly is configured to be axially displaced within said fill column and into said fill position;

wherein said cap assembly comprises a cap body and a cap head mounted to said cap body, said cap head rotatable with respect to said cap body for selectively moving said cap assembly between an opened position and the closed position;

wherein said cap head comprises a flange element extending outwardly from said cap head and said fill column comprises a channel for removably receiving said flange element so that said cap assembly is configured for movement between said opened position and said closed position upon rotation of said cap body.

2. The refill dispenser as in claim 1 wherein said cap body comprises a metering portion and said cap head is mounted to said metering portion, said cap head being configured to rotate about said metering portion for selectively moving said cap head between said opened position and said closed position.

3. The refill dispenser as in claim 1, wherein said cap body comprises said guide element extending outwardly therefrom, said guide element being configured to removably secure said cap body to a groove of said fill column so that said cap head is configured for axial displacement from said cap body upon rotation of said cap body.

4. The refill dispenser as in claim 3, wherein said flange element and said guide element are axially aligned when said cap head is in said closed position.

5. The refill dispenser as in claim 1, wherein said flange element of said cap head is configured for axial movement within said channel of said fill column when said cap head is moved between said opened position and said closed position.

6. A refill dispenser having a cap assembly comprising:

a cap body having a metering portion;

a cap head mounted to said metering portion, said cap head rotatable about said metering portion of said cap body for selectively moving said cap assembly between an opened position and a closed position;

a guide element provided upon said cap body and configured to removably secure said cap body to a fill column; and a flange element provided upon said cap head and configured to be moveably secured within a channel of said fill column;

wherein, upon rotation of said cap body in said fill column, said cap assembly moves from said closed position toward said open position in a direction opposite a dispensing end of said fill column.

7. The refill dispenser as in claim 6, further comprising a container configured to hold a product, said cap body extending adjacent to said container.

8. The refill dispenser as in claim 6, wherein said cap assembly is configured for movement between said opened position and said closed position through axial displacement of said cap head from said cap body and within said channel of said fill column resulting from rotation of said cap body about said fill column.

9. The refill dispenser as in claim 6, wherein said flange element and said guide element are axially aligned when said cap head is in said closed position.

10. A refill dispenser in combination with a fill column comprising:

a container configured to hold a product;

a cap assembly extending adjacent to said container and comprising:

a cap body;

a cap head mounted to said cap body, said cap head rotatable with respect to said cap body for selectively moving said cap assembly between an opened position and a closed position; and a guide element provided upon said cap assembly; and a fill column comprising inner and outer peripheries, wherein said outer periphery comprises a housing mount for securing a housing to said outer periphery of said fill column and said inner periphery comprises a groove extending along the inner periphery of the fill column a length to allow for rotation of the cap body in the fill column and for removably receiving said guide element so that said cap assembly is moved between said opened position and said closed position upon rotation of said cap body in said fill column with said guide element moving within said groove.

11. The refill dispenser in combination with a fill column as in claim 10, wherein said cap body comprises a metering portion and said cap head is mounted to said metering portion, said cap head configured to rotate about said metering portion for selectively moving said cap assembly between said opened position and said closed position.

12. The refill dispenser in combination with a fill column as in claim 10, wherein said cap body comprises said guide element extending outwardly therefrom, said guide element being configured to removably secure said cap body to said groove of said fill column so that said cap head is displaced from said cap body upon rotation of said cap body about said fill column.

13. The refill dispenser in combination with a fill column as in claim 10, wherein said cap head comprises a flange element extending outwardly therefrom, said flange element being configured to be rotatably secured in a channel of said fill column so that said cap head is displaced from said cap body upon rotation of said cap body about said fill column, the channel sized to inhibit rotation of the cap head upon rotation of the cap body.

14. The refill dispenser in combination with a fill column as in claim 13, wherein said flange element and said guide element are axially aligned when said cap head is in said closed position.

15. The refill dispenser in combination with a fill column as in claim 10, further comprising a container configured to hold a product, said cap assembly extending adjacent to said container.

16. The refill dispenser in combination with a fill column as in claim 10, wherein said cap head is configured to be axially displaced from said cap body upon rotation of said cap body about said fill column in order to move said cap assembly between said opened position and said closed position.

17. The refill dispenser in combination with a fill column as in claim 10, further comprising a discharge tube providing fluid communication between a receptacle and said fill column for delivering said product from said receptacle when dispensing said product from said receptacle, said cap head received in said fill column to deliver said product to said receptacle through said discharge tube.

* * * * *